United States Patent [19]

Hann

[11] 4,033,853

[45] July 5, 1977

[54] PROCESS AND APPARATUS FOR HEATING AND DEAERATING RAW BITUMINOUS FROTH

[75] Inventor: Thomas C. A. Hann, Fort McMurray, Canada

[73] Assignee: Great Canadian Oil Sands Limited, Toronto, Canada

[22] Filed: Jan. 16, 1976

[21] Appl. No.: 649,608

[52] U.S. Cl. ..... 208/11 LE; 196/14.52

[51] Int. Cl.[2] ..... C10G 1/04

[58] Field of Search ..... 208/11 LE; 196/14.52; 23/270.5 R; 137/13; 417/179; 210/44, 56, 73 W; 34/57 R

[56] References Cited

UNITED STATES PATENTS

| | | | |
|---|---|---|---|
| 1,520,752 | 12/1924 | Horwitz | 208/11 LE |
| 3,159,562 | 12/1964 | Bichard et al. | 208/11 LE |
| 3,208,930 | 9/1965 | Andrassy | 196/14.52 |
| 3,228,115 | 1/1966 | Swanson et al. | 34/57 R |
| 3,509,641 | 5/1970 | Smith et al. | 208/11 LE |
| 3,667,131 | 6/1972 | Stephanoff | 34/57 R |
| 3,864,251 | 2/1975 | Cymbalisty | 210/56 |
| 3,927,479 | 12/1975 | Stephanoff | 34/57 R |

*Primary Examiner*—Delbert E. Gantz
*Assistant Examiner*—James W. Hellwege
*Attorney, Agent, or Firm*—Donald R. Johnson; J. Edward Hess; James H. Phillips

[57] ABSTRACT

In order to collect, heat and deaerate raw bituminous froth prior to upgrading that froth to synthetic crude oil, a central collection zone is provided for collecting the raw froth which is transferred therefrom to a deaeration zone by means of a conduit having a plurality of steam injection means disposed therein and oriented to urge the froth toward the deaeration zone. The deaeration zone may include a plurality of baffles across which the heated froth is distributed in order to facilitate the release of gases as the froth spills over the baffles. An outlet in a lower portion of the deaeration zone permits transfer by pumping or other means for further treatment of the froth.

3 Claims, 1 Drawing Figure

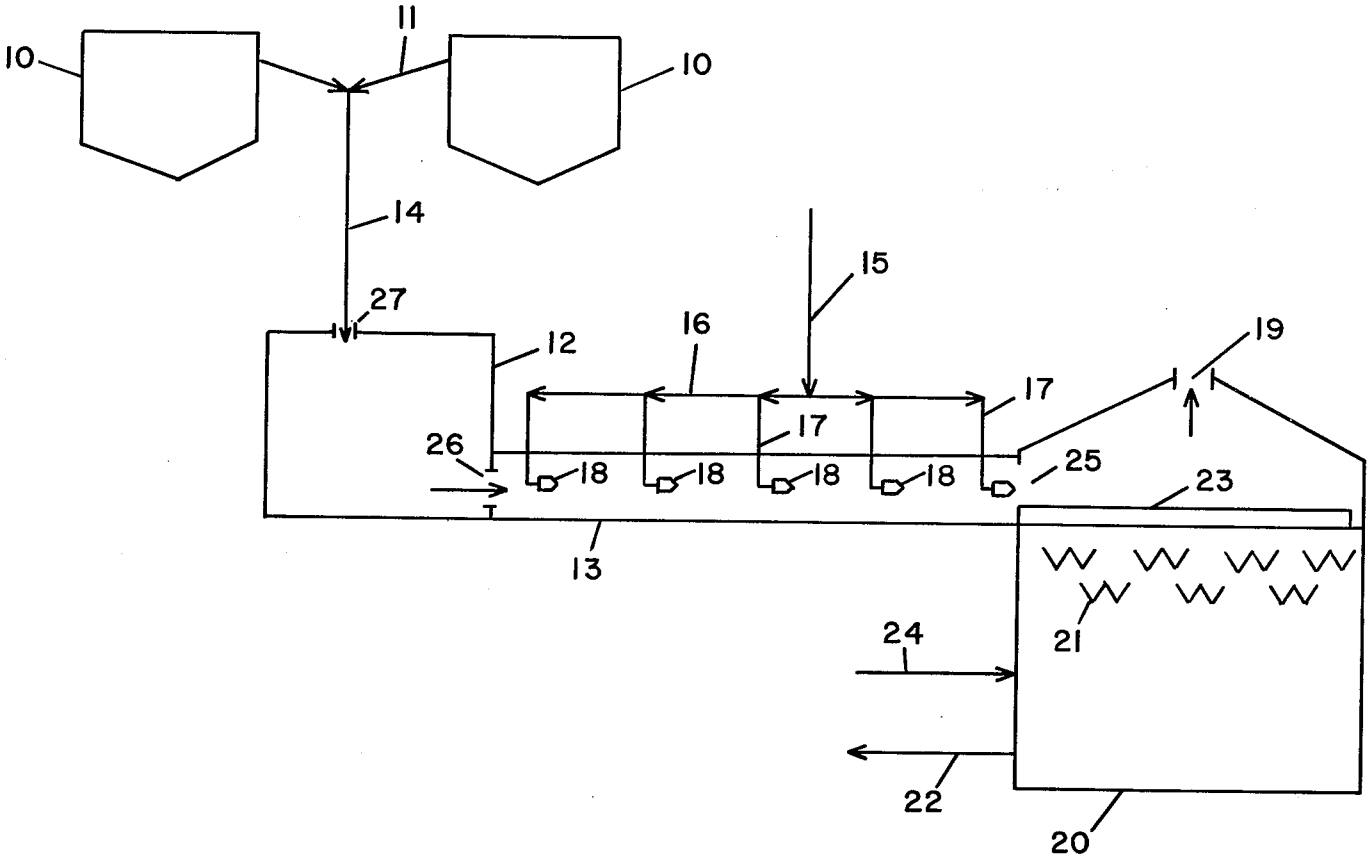
10
10
11
14
27
12
26
16
18
18
18
18
13
15
17
17
19
25
23
21
20
24
22

PROCESS AND APPARATUS FOR HEATING AND DEAERATING RAW BITUMINOUS FROTH

BACKGROUND OF THE INVENTION

The present invention is related to apparatus suitable for collecting, heating and deaerating raw bituminous froth prior to upgrading that froth to synthetic crude oil.

Tar sands, which are also known as oil and bituminous sands, are siliceous materials which are impregnated with a heavy petroleum. The largest and most important deposits of the sands are the Athabasca sands, found in northern Alberta, Canada. These sands underlay more than 13,000 square miles at a depth of 0 to 2,000 feet. Total recoverable reserves after extraction and processing are estimated at more than 300 billion barrels. Tar sands are primarily silica, having closely associated therewith an oil film which varies from about 5 to 21% by weight, with a typical content of 13 weight percent of the sand. The oil is quite viscous—6° to 10° API gravity—and contains typically 4.5% sulfur and 38% aromatics. In addition to the oil and sand components, tar sands contain clay and silt in quantities of 1 to 10% by weight, in the form of a film around the sand grains.

Several basic extraction methods have been known for many years for the separation of oil from the sands. In the so-called "cold water" method, the separation is accomplished by mixing the sands with a solvent capable of dissolving the bitumen constituent. The mixture is then introduced into a large volume of water, water with a surface agent added, or a solution of a neutral salt in water, which salt is capable of acting as an electrolyte. The combined mass is then subjected to a pressure or gravity separation.

In the hot water method, as disclosed in Canadian Pat. No. 841,581 issued May 12, 1970, the bituminous sands are jetted with steam and mulled with a minor amount of hot water at temperatures of 170° to 190° F, and the resulting pulp is then dropped into a turbulent stream of circulating hot water and carried to a separation cell maintained at a temperature of about 185° F. In the separation cell, sand settles to the bottom as tailings and oil rises to the top in the form of a froth. An aqueous middlings layer comprising clay and silt and some oil is formed between these layers. This basic process may be combined with a scavenger step for further treatment of the middlings layer obtained from the primary separation step to recover additional amounts of oil therefrom.

The bituminous froth produced by this process is recovered at a temperature in the range of about 140° to 180° F and normally has a specific gravity in the range of 0.85 to 0.95. Generally, the froth contains 30 to 70 volume percent air. In recovering bituminous froth utilizing the process disclosed in Canadian Pat. No. 841,581 and the hot water separation cell disclosed in Canadian Pat. No. 882,667 issued Oct. 5, 1971, the froth is recovered in overflow launders disposed on the upper edge of the extraction cell. Thereafter, the froth flows by gravity into a collection vessel located near the separation cell below the level of the froth collection launders. Often, one collection vessel serves four or more separation cells at the same time to provide a central collection means for recovered froth. Froth from secondary scavenger steps as disclosed in the above-noted hot water process can also be collected in this same vessel. Thereafter, the froth is heated and transferred to a centrifuge zone or other means of demineralizing and dehydration. Normally, the froth is diluted with a liquid hydrocarbon before the demineralization and dehydration steps. Methods of accomplishing water and mineral removal from the froth are disclosed in Canadian Pat. Nos. 910,271 issued Sept. 19, 1972 and 918,091 issued Jan. 2, 1973.

Raw bituminous froth as recovered from the hot water extraction cell resembles a liquid foam containing minerals, water and air and having poor flow characteristics. The froth is difficult to pump and therefore must be treated to improve its liquid flow characteristics if it is to be processed in a reasonable manner. Canadian Pat. No. 630,710 issued Nov. 7, 1961 discloses that bituminous froth can be collected and transferred to a deaeration zone where it is heated with steam at subatmospheric pressures to remove air bubbles from the froth. This end can be accomplished by adding the froth to a steam heated oil bath maintained at subatmospheric pressure. The froth is therein diluted with oil and agitated to aid in freeing air bubbles from the froth. Although this method improves the froth, transferring the froth to the treatment apparatus disclosed renders the process cumbersome. By the method of the present invention the processing of bituminous froth is improved.

DESCRIPTION OF THE INVENTION

The present invention relates to a method and apparatus for processing bituminous froth recovered via the hot water extraction of bitumen from tar sands. Specifically, the present invention provides a method and apparatus for heating and deaerating raw bituminous froth to provide a product suitable for processing to obtain synthetic crude oil.

Raw bituminous froth normally contains 30 to 70 volume percent air and is reasonably viscous at the temperature at which it is normally recovered, i.e., 120° to 180° F. Therefore, it is very difficult to transfer froth by ordinary methods such as pumping. However, if the froth is heated, and deaerated and diluted with a less viscous hydrocarbon liquid prior to transferring the froth from the recovery area, the treated froth is substantially easier to upgrade to synthetic crude oil. The present invention includes a method and apparatus to provide a heated deaerated bitumen froth product.

Specifically, the apparatus of the present invention comprises a central collection zone for collecting the raw bituminous froth obtained by the hot water extraction of tar sands; a conduit which communicates with the collection zone and a deaeration zone; and finally a deaeration zone wherein the heated froth is deaerated and admixed with a hydrocarbon diluent.

The collection zone can comprise a tank perferably with inlet means at or near the top of the tank and an outlet means at or near the bottom of the tank to utilize gravity as an aid in transferring froth from the tank.

The heating conduit provides a means of transferring the froth from the collection zone while concurrently heating the froth to aid in collapsing the air pockets in the froth and releasing entrapped air therefrom. The conduit can be a pipe or tube having one end, the inlet end, communicating with the outlet of the collection zone and the opposite end, the outlet, communicating with the inlet of the deaeration zone. The conduit contains steam injection means disposed within the conduit by which steam under pressure is injected into the froth in a manner so that the force of the steam propels the froth in the conduit in the direction of the outlet of the conduit. Concurrently the froth is heated while being transferred in the conduit.

The deaeration zone can comprise a vertical tank having an inlet in the upper end thereof communicating with the outlet of the heating conduit. The deaeration zone can have an open top or a top with a means for venting gases from the tank. Also, the deaeration zone contains a means for adding liquid hydrocarbon diluent and a means for withdrawing diluted froth. An essential feature of the deaeration zone is a distributor means located adjacent to the inlet in the top of the tank. The distribution means provides for the distribution of the heated froth over a majority of the cross section of the deaeration zone to facilitate release of gases from the froth. Located below the distribution means in the deaeration zone are baffles which aid in froth deaeration also.

As a means for providing a more detailed description of one mode of the apparatus of the present invention, the figure in the drawing is presented. Referring to the figure, bituminous froth containing 30 to 70% by volume of air is transferred from hot water extraction separation cells 10 to collection zone 12 via lines 11 and 14 respectively. The froth is quite viscous at 150° F having a viscosity of about 2000 centipoise. The froth flows by gravity to collection zone 12. Froth collection zone 12 can be any vessel suitable for storing liquids which has an inlet and an outlet for the addition and withdrawal of liquids. Preferably the inlet 27 is located in the upper part of zone 12 and the outlet 26 is located in the lower section thereof. By this arrangement withdrawal of liquids from the zone can be aided by gravity.

Communicating with the outlet 26 of zone 12 is conduit 13 wherein the froth is heated and transferred to deaeration zone 20. Conduit 13 can be a pipe or tube suitable for transporting liquids. Disposed within conduit 13 are steam injection means 18 which can be any nozzle suitable for providing steam under pressure into conduit 13. Steam injection means 18 are positioned in conduit 13 to provide steam under pressure directed towards the outlet end of the conduit thereby propelling the froth through the conduit while concurrently heating the froth. Steam is supplied to injection means 18 via line 15, 16 and 17 respectively.

As noted above, the inlet end of conduit 13 communicates with the outlet 26 of zone 12. The outlet of conduit 13 communicates with the inlet means of deaeration zone 20 at inlet 25. Conduit 13 can be parallel to the plane of the horizontal axis or can be disposed at an angle of up to 10° from the horizontal axis with the outlet of the conduit being above the inlet thereof. When a liquid such as bituminous froth is heated in conduit 13 the entrapped air rises to the upper section in the conduit and tends to migrate to the highest level in the conduit. Thus, preferably the conduit has its outlet raised higher than the inlet to promote flow of gas pockets in the direction of the outlet rather than in the inlet direction.

Deaeration zone 20 can be any tank or other facility suitable for storing liquids having an inlet means 25 in the upper end thereof and a liquid withdrawal means 22 at the lower end thereof. Also zone 20 can be a open top tank or have a top with a vent 19 as illustrated in the figure. Disposed in the upper end of deaeration zone 20 is distributor means 23, which serves to disperse the froth preferably over the entire cross section of deaeration zone 20 thereby permitting the froth to cascade down over baffles 21 into the lower section of deaeration zone 20. Distribution means 23 can be any of the various structures such as a box with a perforated bottom or a series of channels having weirs whereby the froth overflows the weir onto the baffles 21 therebelow.

Air bubbles formed in the froth as a result of the steam injection are released from the froth as it cascades over the baffles in zone 20. The heated deaerated froth thereafter collects in the lower section of zone 20 wherein it can be admixed with a liquid hydrocarbon diluent from line 24 and thereafter transferred by pumping or other means for further processing via exit line 22.

Thus, the present invention comprises an apparatus for transferring, heating and deaerating bituminous froth recovered from the hot water extraction of bitumen from tar sands comprising in combination:

a. a froth collection zone comprising a tank having an inlet and an outlet;

b. a froth deaeration zone comprising a tank having an inlet means in the upper section thereof and an outlet means in the lower section thereof; a distribution means located in the upper section of said tank and communicating with said inlet means whereby incoming froth is distributed over the cross section of the tank; a plurality of deflecting baffles located below said distribution means and above said outlet means; and c. a conduit for heating and transferring bituminous froth comprising a tube having an inlet communicating with the outlet of said froth collection zone and an outlet communicating with the inlet of said froth deaeration zone said conduit having steam injecting means disposed therein, the outlet of said steam injection means being disposed to direct steam to the outlet end of said conduit to thereby concurrently heat and pump froth in said conduit from the inlet to the outlet end thereof.

The improvement realized in the apparatus and method of the present invention substantially lies in the transfer of the froth via injected steam propulsion from the collection zone to the deaeration zone through the novel heating transfer conduit. Also, the deaeration zone provides efficient release of entrapped gasses from the froth by the cascading effect achieved through the distribution means within the deaeration zone. The distribution means within the deaeration can be any arrangement which disperses the heated froth over the cross section of the deaeration zone. Various arrangements on structural configurations of baffles within the deaeration zone can be employed within the concept of the present invention.

The present invention also comprises that in a method for heating and deaerating bituminous froth containing up to 70 volume percent occluded air, said method comprising collecting the froth in a collection zone and subsequently deaerating the froth in a deaeration zone, the improvement which comprises transferring the froth from the collection zone to the deaeration through a conduit wherein the froth is contacted with steam directionally provided to cause the froth to flow from the collection zone to the deaeration zone, said steam concurrently heating the froth to cause formation of gas pockets therein, thereby effecting improved deaeration in said deaeration zone.

The present invention also provides that in an apparatus for processing bituminous froth containing a froth collection zone and a deaeration zone, the improvement which comprises a conduit having one end communicating with said collection zone and the opposite end communicating with said deaeration zone, said conduit having disposed therein steam injection means positioned to inject steam under pressure into said conduit in the direction of said deaeration zone to cause fluid materials in said conduit to flow from said collection zone to said deaeration zone.

The invention claimed is:

1. In a method for heating and deaerating bituminous froth containing up to 70 volume percent occluded air, said method comprising collecting the froth in a collection zone and subsequently deaerating the froth in a deaeration zone, the improvement which comprises transferring the froth from the collection zone to the deaeration zone through a conduit wherein the froth is contacted with stream directionally provided to cause the froth to flow from the collection zone to the deaeration zone, said steam concurrently heating the froth to cause formation of gas pockets therein, thereby effecting improved deaeration in said deaeration zone.

2. An apparatus for processing bituminous froth recovered from the hot water extraction of bitumen from tar sands comprising in combination:

a. a froth collection zone comprising a tank having an inlet and an outlet;

b. a froth deaeration zone comprising a tank having an inlet means in the upper section thereof and an outlet means in the lower section thereof; a distribution means located in the upper section of said tank and communicating with said inlet means whereby incoming froth is distributed over the cross section of the upper section of the tank; a plurality of deflecting baffles located below said distribution means and above said outlet means; and c. a conduit for heating and transferring bituminous froth from said collection zone to said deaeration zone comprising a tube having an inlet communicating with the outlet of said froth collection zone and an outlet communicating with the inlet of said froth deaeration zone said conduit having steam injection means disposed therein, the outlets of said steam injection means being disposed to direct steam toward the outlet end of said conduit to thereby concurrently heat and pump froth in said conduit from the inlet to the outlet end thereof.

3. In an apparatus for processing bituminous froth containing a froth collection zone and a deaeration zone, the improvement which comprises a conduit having one end communicating with said collection zone and the opposite end communicating with said deaeration zone, said conduit having disposed therein steam injection means positioned to inject steam under pressure into said conduit in the direction of said deaeration zone to cause fluid materials in said conduit to flow from said collection zone to said deaeration zone.

* * * * *